US005450958A

United States Patent [19]

Shin

[11] Patent Number: 5,450,958

[45] Date of Patent: Sep. 19, 1995

[54] FOAM ORGANIZER BAG

[76] Inventor: Han S. Shin, 293-24, Dok San 1-Dong, Kuro-Ku, Seoul, Rep. of Korea

[21] Appl. No.: 103,667

[22] Filed: Aug. 10, 1993

Related U.S. Application Data

[63] Continuation of Ser. No. 924,563, Aug. 3, 1992, Pat. No. 5,311,987.

[30] Foreign Application Priority Data

Feb. 29, 1992 [KR] Rep. of Korea ..... 91-3141

[51] Int. Cl.[6] ..... A63B 55/00

[52] U.S. Cl. ..... 206/315.6; 206/315.3

[58] Field of Search ..... 206/315.2, 315.3, 315.4, 206/315.5, 315.6; 280/DIG. 6; 211/70.2; 248/96

[56] References Cited

U.S. PATENT DOCUMENTS

| | | | |
|---|---|---|---|
| 1,483,475 | 2/1924 | Osterhoudt . | |
| 1,731,588 | 10/1929 | Patterson . | |
| 1,886,464 | 11/1932 | Bright . | |
| 1,956,008 | 4/1934 | Deibel . | |
| 2,114,870 | 4/1938 | Calkins | 206/315.6 |
| 2,534,096 | 12/1950 | Zapoleon . | |
| 2,551,780 | 5/1951 | Wood . | |
| 2,595,987 | 5/1952 | Shears . | |
| 2,722,258 | 11/1955 | Smidt et al. | 206/315.6 |
| 2,752,973 | 7/1956 | Stamp . | |
| 2,799,315 | 7/1957 | Strasburg . | |
| 2,879,819 | 3/1959 | Turnbull . | |
| 3,164,185 | 1/1965 | Ingoldt . | |
| 3,530,919 | 9/1970 | May | 206/315.5 X |
| 3,554,255 | 1/1971 | Mangan | 206/315.6 |
| 3,664,399 | 5/1972 | Neff . | |
| 3,866,646 | 2/1975 | Nevard . | |
| 3,941,398 | 3/1976 | Nelson | 206/315.4 X |
| 3,980,115 | 9/1976 | Longo | 206/315.6 |
| 3,985,229 | 10/1976 | Maki . | |
| 4,055,207 | 10/1977 | Goodwin . | |
| 4,173,241 | 11/1979 | Stock . | |
| 4,241,774 | 12/1981 | Pell | 206/315.6 |
| 4,378,832 | 4/1983 | Thompson . | |
| 4,383,563 | 5/1983 | Kirchoff, Jr. | 306/315.5 X |
| 4,497,404 | 2/1985 | Lowrance | 206/315.2 |
| 4,664,382 | 5/1987 | Palmer et al. | 206/315.6 X |
| 4,890,731 | 1/1990 | Mroz | 206/315.9 |
| 5,311,987 | 5/1994 | Shin | 206/315.6 |

FOREIGN PATENT DOCUMENTS

| | | | |
|---|---|---|---|
| 2130102 | 5/1984 | United Kingdom | 206/315.6 |
| 2234912 | 2/1991 | United Kingdom | 206/315.3 |

*Primary Examiner*—Sue A. Weaver

*Attorney, Agent, or Firm*—John J. Connors; Connors & Associates

[57] ABSTRACT

A foam organizer for a golf bag includes a removable receptacle structure which has a plurality of lengthwise holes, each of which receives only on golf club. The receptacle structure is made of hard, light weight, extruded foam material having a waterproof property in the form of closed cells.

2 Claims, 4 Drawing Sheets

FOAM ORGANIZER BAG

This is a continuation of application Ser. No. 07/924,563, filed Aug. 3, 1992, U.S. Pat. No. 5,311,987.

BACKGROUND OF THE INVENTION

1. Field of the Invention

The present invention relates to a foam organizer bag, namely, a golf bag, and more particularly to a foam organizer bag providing an improved golf club receptacle structure for storing a plurality of golf clubs therein which are separated from one another to prevent the golf clubs from clashing against each other. This suppresses noise and, more importantly, protects the golf clubs, particularly graphite shaft clubs.

2. Background Discussion

A conventional golf bag, as shown in FIG. 1 provides a predetermined number of partition walls 30 arranged at the upper portion of a body 10 in a criss-crossing configuration for form a plurality of receptacle 20, each of which receives a few golf clubs, as on desires. But this golf club receptacle structure has difficulties in managing the golf bag. In general, the golf bag has ten golf clubs, or more, which are properly classified in each of receptacles 20, for example, thirteen clubs in a woman's case and fourteen clubs in a man's case. During carrying of the golf bag, the clapping between the grouped golf clubs stored therein causes noise and also damages them at the lower portion rather than at the upper portion. Furthermore, when the golf bag is mistakenly dropped and turned over, the golf club grip is cracked or otherwise damaged.

The present invention is devised to resolve these problems, and its main objective is to provide a foam organizer bag with an improved golf club receptacle structure for removing the cause of the noise by the clashes between grouped golf clubs stored therein as well as for assuring the reliable protection and maintenance of the golf clubs, particularly golf clubs with graphite shafts.

SUMMARY OF THE INVENTION

The golf bag of this invention has several features, no single one of which is solely responsible for its desirable attributes. Without limiting the scope of this invention as expressed by the claims which follow, its more prominent features will now be discussed briefly. After considering this discussion, and particularly after reading the section entitled, "DETAILED DESCRIPTION OF THE PREFERRED EMBODIMENTS," one will understand how the features of this invention provide its advantages, which include low cost manufacture, protection of golf clubs, noise reduction or elimination, light weight, and simplicity of use.

To accomplish these objects and features, the present invention provides a receptacle member made of foam and having a plurality of holes, or channels, extending lengthwise. Each hole, or channel, receives only one golf club. The receptacle member is preferably sized to range from equal in height of the golf bag to ⅓ of the height of the golf bag. Hard sponge materials having a waterproof property in the form of closed cells is preferred, such as, for example, polyurethane foam. This receptacle member may be extruded from a mold. The receptacle holes or channels are perforated in the structure based on the number of golf clubs to be stored, and only one golf club is stored in a single hole or channel.

Therefore, the receptacle member absorbs the impacts caused due to the shaking of the stored golf clubs during the carrying. Especially, the receptacle member is manufacturable in the form of a removable, foam insert to be used in any shape of golf bag. That is, the cross-sectional configuration of the receptacle structure conforms to the cross-sectional configuration of the cavity of the golf bag so that this receptacle structure fits snug in the cavity, but can be removed. The receptacle structure is near the open top of the cavity of the golf bag, and extends into the cavity from an open top of the cavity. One of the important features of the receptacle is that it is light weight, having a density of 12 pounds per cubic feet or less, preferably from 10 to 12 pounds per cubic feet.

DESCRIPTION OF THE DRAWING

The preferred embodiment of this invention, illustrating all its features, will now be discussed in detail. This embodiment depicts the novel and non-obvious device of this invention shown in the accompanying drawing, which is for illustrative purposes only. This drawing includes the following figures (FIGS.), with like numerals indicating like parts.

DESCRIPTION OF THE PREFERRED EMBODIMENTS

Figure 1:
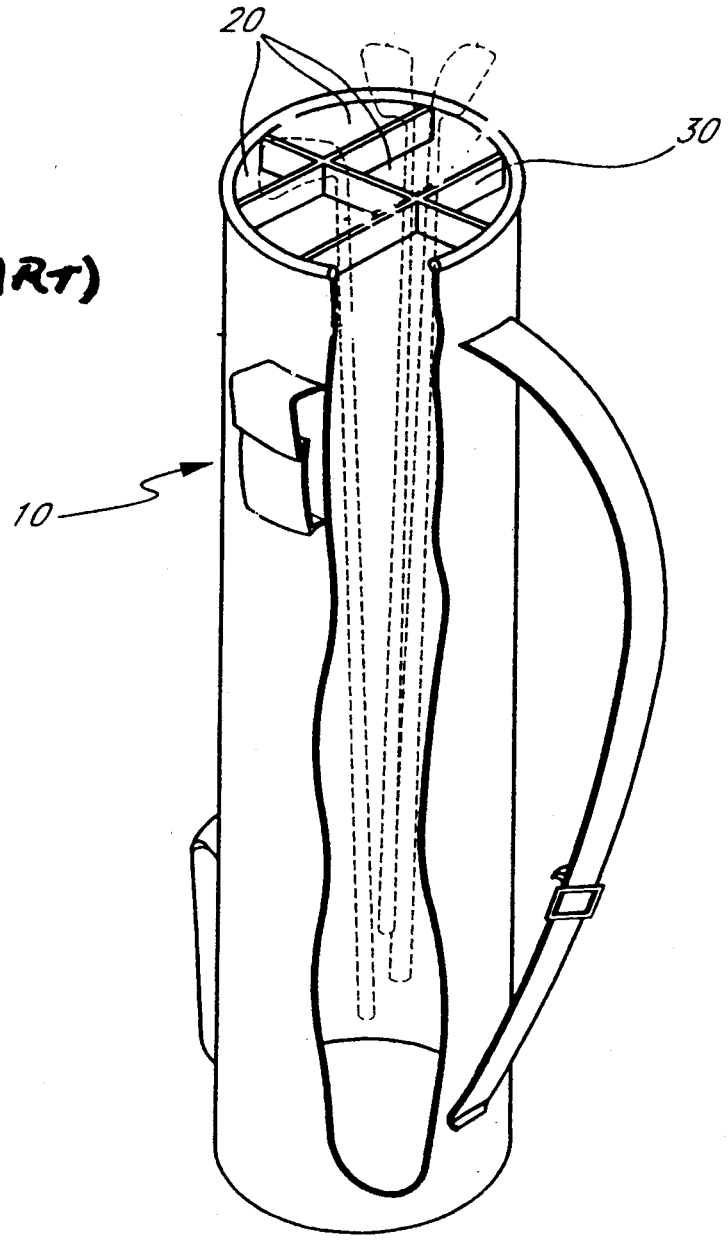
FIG. 1 (PRIOR ART)
FIG. 1 is a schematically perspective view illustrating the configuration of a conventional golf bag.
Figure 2:
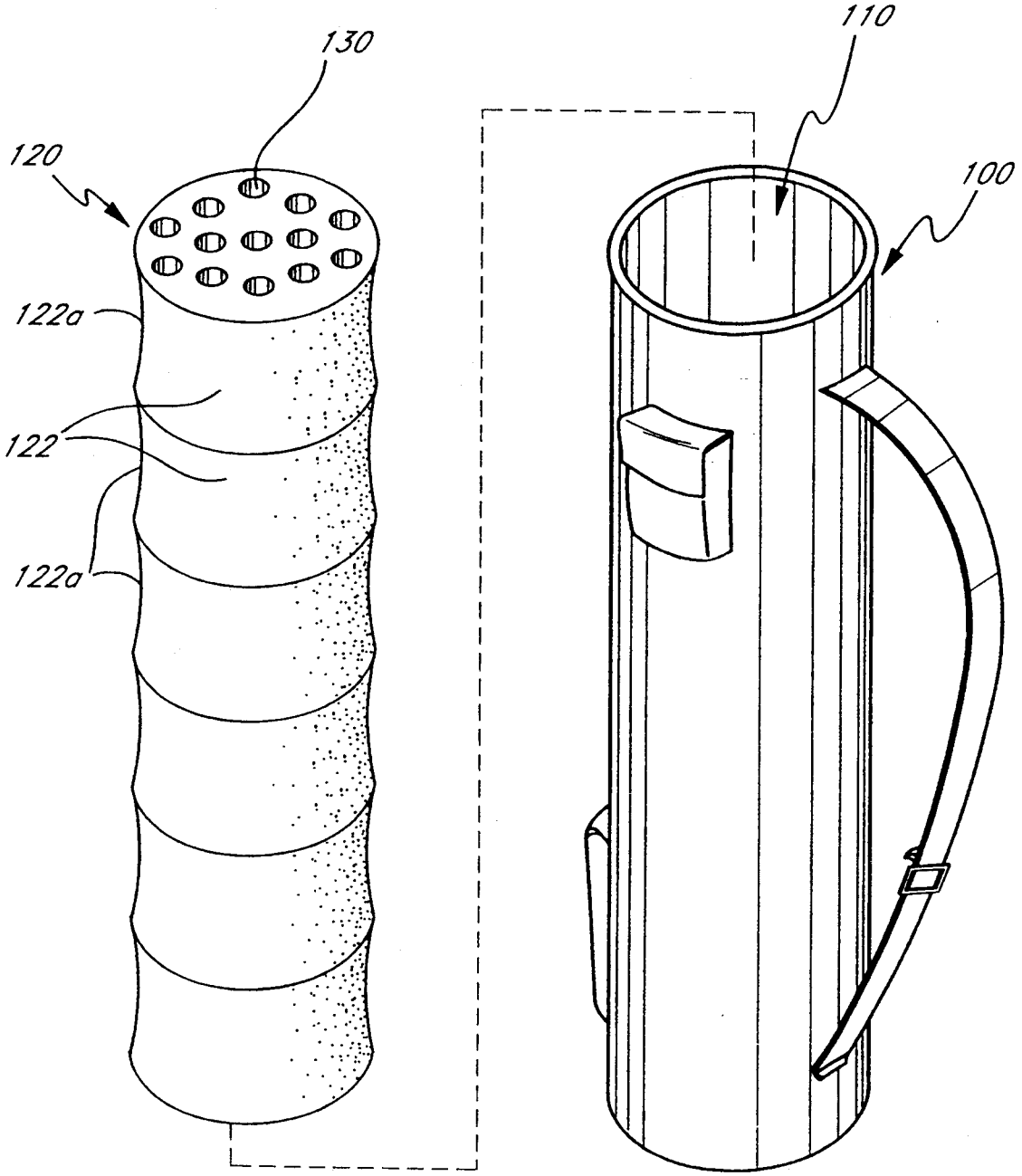
FIG. 2 is an exploded perspective new illustrating the configuration of a foam organizer bag according to the present invention.

Referring to FIG. 2, a foam organizer bag 100 is illustrated in an exploded perspective view. The foam organizer bag 100 includes a normal golf bag having a cavity 110 to receive a plurality of golf clubs and a receptacle member 120 fitted into the cavity 110. The receptacle member 120 is provided with a plurality of holes or channels 130 formed in a longitudinal or lengthwise direction to store a number of golf clubs, respectively in each channel 130. The receptacle member 110 is made of hard sponge material in the form of the circular pole to absorb the impacts caused by the vibration of a golf club.

Also, the receptacle member 110 includes a plurality of unit members 122 which are attached in a stacked configuration to one another by means of a suitable adhesive. The unit member 122 is provided with a concaved portion **122*a* formed around the middle portion of its circumference that is fitted snug into the cavity 110. The receptacle member 110 is designed to minimize the shaking of the member within the cavity 110**.

Figure 3:
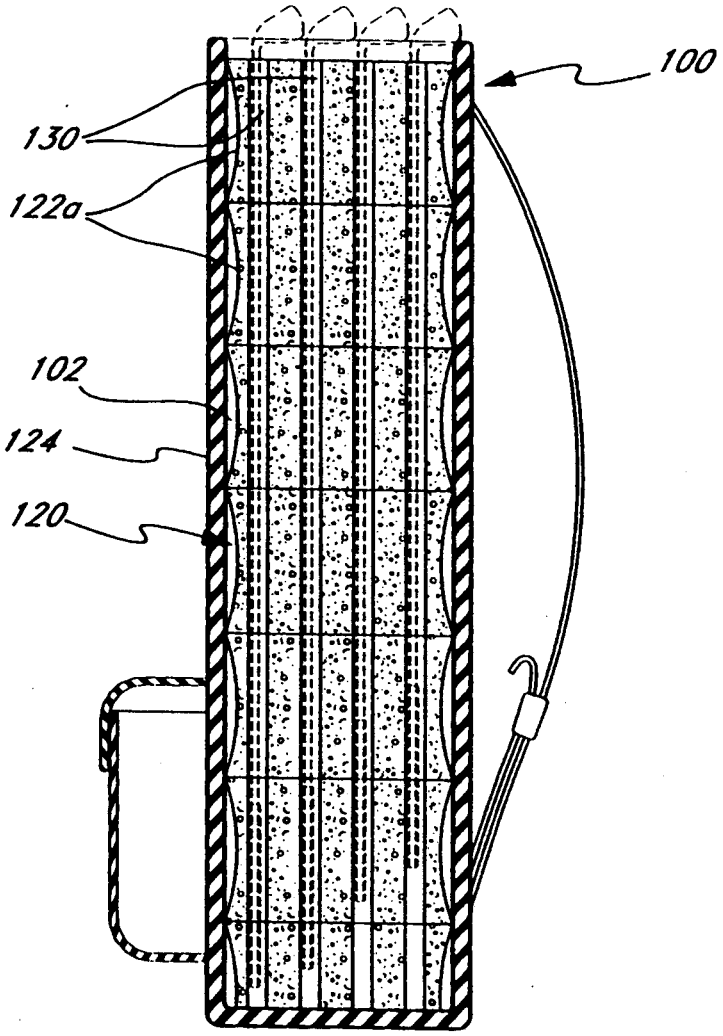
FIG. 3 is a cross-sectional view illustrating the installation of a receptacle member in a foam organizer bag according to the present invention.

Concretely, the receptacle member 120 includes a plurality of through-holes 130 formed from the upper portion to the lower portion, into each of which only one corresponding golf club is inserted. When the receptacle member 120 is fitted into the cavity 110, as shown in FIG. 3, a plurality of mountain portions 124 formed on contact with the unit members 122 to one another are pressed against the inner wall of the bag 100. At that time the concaved portion **122*a* compensates for the pressing state to receive the receptacle member 120 into the cavity 110, flexibly, thereby removing or reducing the shaking of the receptacle member 120 itself. Therefore, a plurality of golf clubs are respectively stored into each of holes 130** to prevent their damages and the noises caused due to the clashes therebetween.

Figure 4:
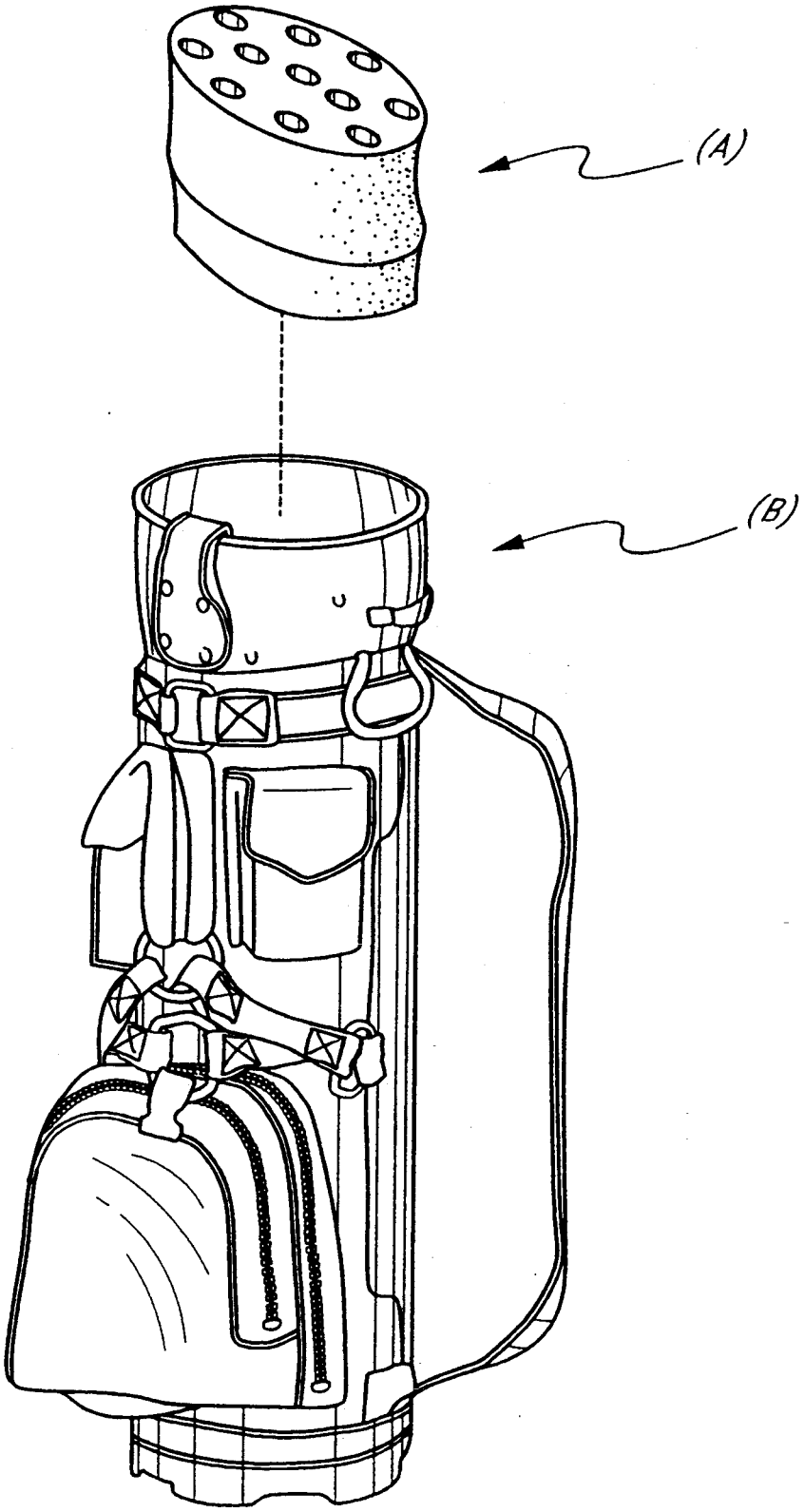
FIG. 4 is an exploded perspective new illustrating another embodiment of a receptacle member for inserting into a normal golf bag according to the present invention.

Furthermore, as shown in FIG. 4, the receptacle member 120 may be made in the form of a foam insert, corresponding in configuration to the configuration of the cavity of a golf bag to be used, and having a height of ⅓ of the height of the golf bag to be used. This member 120 fits snug with the cavity 110 so that it does not tend to move from its position near the open top of the cavity.

Accordingly, the present invention relates to a foam organizer bag, providing a golf club receptacle structure which has a plurality of holes or channels 130 for storing a number of golf clubs in individual channels, but separated from one another, thereby preventing clashing of the clubs to suppress noise and protect the golf clubs against damage.

SCOPE OF THE INVENTION

The above presents a description of the best mode contemplated of carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above which are fully equivalent. Consequently, it is not the intention to limit this invention to the particular embodiment disclosed. On the contrary, the intention is to cover all modifications and alternate constructions coming within the spirit and scope of the invention as generally expressed by the following claims, which particularly point out and distinctly claim the subject matter of the invention.

I claim:

1. A golf bag including an elongated cavity adapted to receive golf clubs, with the shafts of the golf clubs disposed lengthwise in the cavity, said cavity terminating at one end in an open mouth, a golf club receptacle structure having an enlarged, cylindrical-like body made of a foam water proof material having closed cells and a density of no more than 12 pounds per cubic feet, said receptacle structure comprising a plurality of stacked members bonded together with an adhesive, said receptacle structure being disposed in said open mouth and extending from the open mouth lengthwise into the cavity, and including a section of said body adjacent the open mouth which has essentially the same configuration as a section of the cavity adjacent the mouth, so that the receptacle section fits snug within the cavity, and a passageway which extends in a lengthwise direction through said body for receiving a golf club.

2. The golf bag of claim 1 where the receptacle structure is removable.

* * * * *